US007677007B2

(12) United States Patent
Parker

(10) Patent No.: US 7,677,007 B2
(45) Date of Patent: Mar. 16, 2010

(54) INTERLOCKING INSULATING FIREBRICK

(76) Inventor: William H. Parker, 404 Meadow La., Sewickley, PA (US) 15143

( * ) Notice: Subject to any disclaimer, the term of this patent is extended or adjusted under 35 U.S.C. 154(b) by 342 days.

(21) Appl. No.: 11/126,935

(22) Filed: May 11, 2005

(65) Prior Publication Data

US 2006/0272264 A1 Dec. 7, 2006

(51) Int. Cl.
*F27D 1/04* (2006.01)
*E04B 2/34* (2006.01)

(52) U.S. Cl. ..... 52/586.2; 52/605; 52/405.1; 52/565; 52/125.2; 110/336

(58) Field of Classification Search ..... 52/125.2, 52/506.02, 604, 605, 745.2, 405.1, 564, 586.1, 52/586.2, 284, 286; 110/336, 338; D25/113; 294/62, 63.1; 206/322
See application file for complete search history.

(56) References Cited

U.S. PATENT DOCUMENTS

| | | | | | |
|---|---|---|---|---|---|
| 1,879,311 | A * | 9/1932 | Keuls | 52/412 |
| 2,029,586 | A * | 2/1936 | Rendoff | 52/505 |
| 2,087,541 | A * | 7/1937 | Koester | 52/342 |
| 2,107,691 | A * | 2/1938 | Corser | 446/122 |
| 2,269,018 | A * | 1/1942 | Guignon, Jr. | 52/308 |
| 2,443,202 | A * | 6/1948 | Smith | 414/756 |
| 2,701,959 | A * | 2/1955 | Briggs | 52/505 |
| 2,711,003 | A * | 6/1955 | Child, Jr. | 432/159 |
| 3,299,600 | A * | 1/1967 | Rigby | 52/596 |
| 3,378,969 | A * | 4/1968 | Larger | 52/223.7 |
| 4,069,633 | A * | 1/1978 | Cooper et al. | 52/578 |
| 4,716,857 | A * | 1/1988 | Moreau | 122/6 A |
| 5,191,744 | A * | 3/1993 | Bowes | 52/564 |
| 5,282,700 | A * | 2/1994 | Rodrique | 405/284 |
| 5,485,703 | A * | 1/1996 | Nordahl | 52/562 |
| 5,528,873 | A * | 6/1996 | Correia et al. | 52/605 |
| 5,600,930 | A * | 2/1997 | Drucker | 52/585.1 |
| 5,687,531 | A * | 11/1997 | Nelson et al. | 110/338 |
| 5,687,956 | A * | 11/1997 | Vesper | 256/31 |
| 5,729,943 | A * | 3/1998 | Cambiuzzi | 52/438 |
| 5,921,046 | A * | 7/1999 | Hammond, Jr. | 52/564 |
| 6,389,758 | B1 * | 5/2002 | Martin, Jr. | 52/125.2 |
| 6,679,021 | B2 * | 1/2004 | Maimon et al. | 52/592.1 |
| 6,851,235 | B2 * | 2/2005 | Baldwin | 52/309.17 |
| 7,270,497 | B2 * | 9/2007 | Von Langsdorff | 404/39 |
| 2004/0040245 | A1 * | 3/2004 | Sinclair et al. | 52/605 |
| 2005/0036829 | A1 * | 2/2005 | Trull | 403/170 |

FOREIGN PATENT DOCUMENTS

| | | | |
|---|---|---|---|
| JP | 06123560 A | * | 5/1994 |
| JP | 10-185445 | * | 1/1998 |

* cited by examiner

*Primary Examiner*—Robert J Canfield
*Assistant Examiner*—Christine T Cajilig
(74) *Attorney, Agent, or Firm*—Quinn & Quinn P.C.; William J. Quinn; Cornelius P. Quinn

(57) ABSTRACT

A structural configuration for rapidly assembling walls and linings of insulating firebricks and prefabricated insulating modules that aligns the bricks or modules during assembly with grooves and inserts, minimizes the amount of through joints in the completed structure, and allows the full height of each brick or module to be utilized in the completed structure is provided.

6 Claims, 7 Drawing Sheets

INTERLOCKING INSULATING FIREBRICK

FIELD OF THE INVENTION

The present invention relates generally to methods of assembling walls and linings of insulating firebrick; and more particularly, the present invention is directed toward a self-centering and interlocking method which allows accurate and rapid assembly of walls and linings of insulating firebrick, including use of preassembled wall segments.

BACKGROUND OF THE INVENTION

Walls and linings constructed from insulating firebrick are utilized in numerous applications in furnaces, kilns and high temperature applications as primary hot face refractory linings or as insulation behind other refractories. Such walls and linings are typically assembled on-site from smooth sided insulating firebrick and mortar and are laid down in courses.

In industrial furnace and kiln application having walls or linings constructed of insulating firebrick, the furnaces and kilns must be periodically rebuilt. As productivity and profitability are directly impacted by the amount of time taken to rebuild the furnace or kiln, any reduction in the time necessary for a rebuild is desirable.

As an example, insulating firebrick is utilized in the construction of side wall and bottom insulation in carbon anode baking furnaces. Carbon anode baking furnaces are utilized to fire carbon anodes used in the Hall process of smelting aluminum. As 0.4 to 0.5 pounds of anode are consumed in the production of each pound of aluminum, the ability to produce carbon anodes is critical for the production of aluminum. When it becomes necessary for an aluminum smelter to rebuild its carbon anode baking furnace, it must stock pile carbon anodes in order to continue aluminum production during rebuild. Occasionally this is not possible as the carbon anode baking furnace is sized to the needs of the smelter; therefore during a rebuild a smelter must purchase anodes from another source or pause aluminum production.

Attempts have been made in the prior art to supply tongue and groove interlocking insulating firebrick in an attempt to reduce the rebuild time of carbon anode baking furnaces; such attempts have met with limited success as the manufacturing cost of such insulating firebricks is greatly increased. Unlike the tongue and groove in thermally conductive bricks utilized in constructing the flue walls, the tongue and groove in insulating firebricks may not be pressed into the brick's shape during the process of manufacture, but rather must be machined into the fired brick. To machine a tongue into an insulating firebrick is an expensive and time consuming process with the further drawback that the effective height of the insulating firebrick is reduced by the height of the tongue machined into it.

Attempts have also been made in the prior art to provide large prefabricated sidewall insulating modules constructed from insulating firebrick; however difficulties are encountered in aligning and handling such large modules.

Finally, in the prior art, attempts have been made to provide pre-cast modules of tongue and groove design. Such pre-cast modules have been constructed from refractory castable insulating material. Refractory castable insulating material is considerably less durable than insulating firebrick having the same insulating value; as a result, modules constructed from refractory castable insulating material are particularly susceptible to damage in transportation and handling. If a stronger insulating castable is used to produce the modules, the insulating value of the modules is significantly inferior to that of insulating firebrick.

Accordingly, it is an objective of the present invention to provide a method of rapidly assembling durable kiln and furnace linings, and further to provide durable preassembled insulating wall modules, constructed from insulating firebrick, that are self-aligning and interlocking and allow accurate and rapid assembly of side wall insulation.

Other objects and advantages of the present invention will be apparent to those skilled in the art from the following description of the invention.

SUMMARY OF THE INVENTION

The present invention provides a structural configuration for use in rapidly assembling walls and linings from insulating firebricks and from prefabricated insulating modules that aligns the bricks or modules during assembly, minimizes the amount of through joints in the completed structure, and allows the full height of each brick or module to be utilized in the completed structure.

In applications where courses of insulating firebrick are laid on site, each insulating firebricks is machined with a groove in its upper face and its lower face. Although various sizes and grades of bricks may be utilized, typical insulating firebricks employed for insulating walls and linings are about 9 inches wide, 3 inches high, up to 24 inches long and are of ASTM grade 20 to 32. After each course of brick is laid down, an insert of refractory material is laid into the upper grooves of the course of bricks. The shape of the lower portion of the insert corresponds to shape of the upper groove in the insulating firebricks. A further course is then laid down with the groove on the lower faces of the insulating firebrick engaging the upper portion of the insert, the shape of which corresponds to the grooves in the lower faces of the insulating firebricks. The insert may be of any suitable refractory material, shape, size and length, although ceramic tubing of a mullite composition that is 50 mm in outside diameter, 36 mm in inside diameter and in lengths up to 8 feet is preferred, as the material exhibits good strength and thermal shock resistance and is readily available. Utilizing longer length inserts provides the additional advantage of ensuring alignment of walls and linings in completed structures. Additionally, in applications which would significantly benefit from the elimination of vertical through joints, the bricks could also be machined with grooves on their end faces into which an insert would also be placed.

In applications where prefabricated insulating modules can be utilized, such as in the construction of side wall insulation in carbon anode baking furnaces, a similar interlocking groove and insert structural configuration is employed. Although various size modules may be employed, a typical prefabricated insulating module could be about 3 feet tall, 4 feet long and 1.5 feet wide to allow ease of handling. Each prefabricated insulating module is typically constructed of two rows of insulating firebrick in which each row may be constructed from substantially different grades of insulating firebrick. The prefabricated insulating modules are constructed from typical flat sided bricks that are mortared together, with the exception being that bricks, that are to have exposed upper faces, lower faces or end faces that are to engage an insert, are appropriately machined to form the necessary grooves in the prefabricated module. Where prefabricated insulating modules are constructed with rows of insulating firebrick that are of predominantly different grades, the grooves formed in the top, bottom, and end faces of the prefabricated insulating modules are preferably offset from center to ensure that the proper side of the module faces inward when installed.

The prefabricated insulating modules are assembled together in similar fashion to a series of bricks. As each prefabricated insulating module is laid down next to an adjacent prefabricated insulating module, an insert, as previously described, is placed between the grooves in the end faces of the prefabricated insulating modules. As prefabricated insulating modules are laid down in a successive course, an insert is first placed within the groove formed in the top face of the lower course of prefabricated insulating modules.

The grooves in the side and bottom faces of each prefabricated insulating module may also be utilized to lift and place each prefabricated insulating module. Banding material comprised of any suitable material of sufficient strength, that will not break during the lifting process, fits within the end and bottom grooves of a prefabricated insulating module, and is utilized to lift and align the module. The banding material need not be removed, but if selected of appropriate material, will simply burn away in operation.

DETAILED DESCRIPTION OF THE DRAWINGS

A first embodiment of the present invention will now be described with reference to FIGS. 1 through 4.

Figure 1:
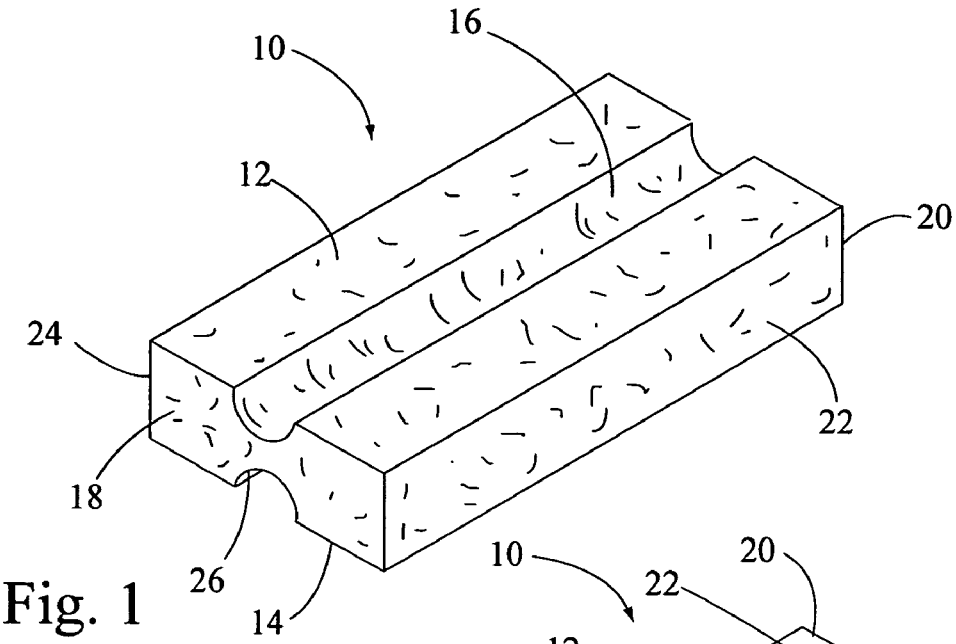
FIG. 1 is a three-dimensional perspective view of an insulating firebrick of the first embodiment of the present invention.

FIG. 1 illustrates a typical insulating firebrick 10 of the present invention. The uppermost face of insulating firebrick 10 will be referred to as its top face 12; and the lowermost face of insulating firebrick 10 will be referred to as its bottom face 14. An upper groove 16 is fashioned in the top face 12 of insulating firebrick 10 extending from flat end face 18 to flat end face 20 and perpendicular to side faces 22 and 24. A lower groove 26 is fashioned in the bottom face 14 of insulating firebrick 10 extending from flat end face 18 to flat end face 20 and perpendicular to side faces 22 and 24.

Figure 2:
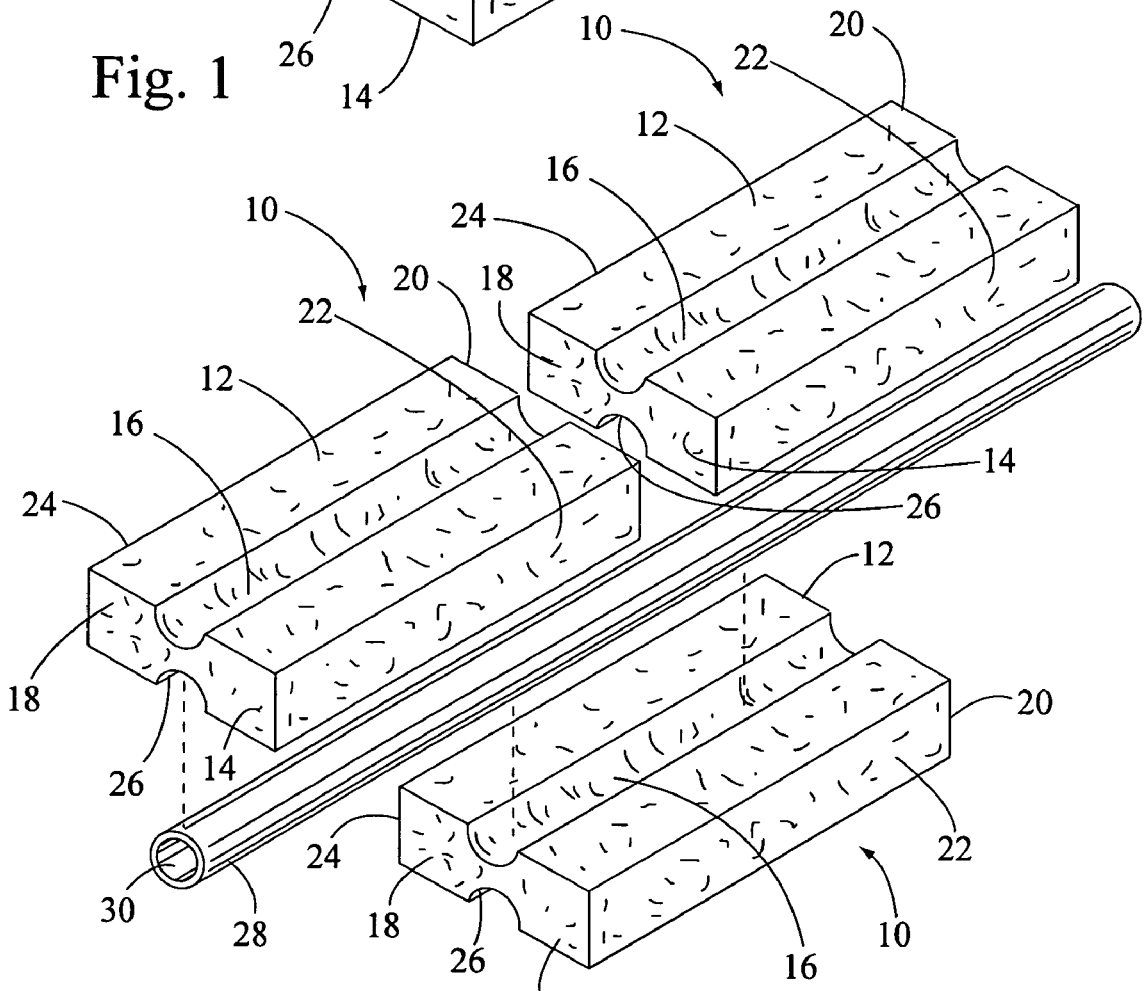
FIG. 2 is a three-dimensional exploded view illustrating the assembly of insulating firebricks with a ceramic insert of the first embodiment of the present invention.
Figure 3:
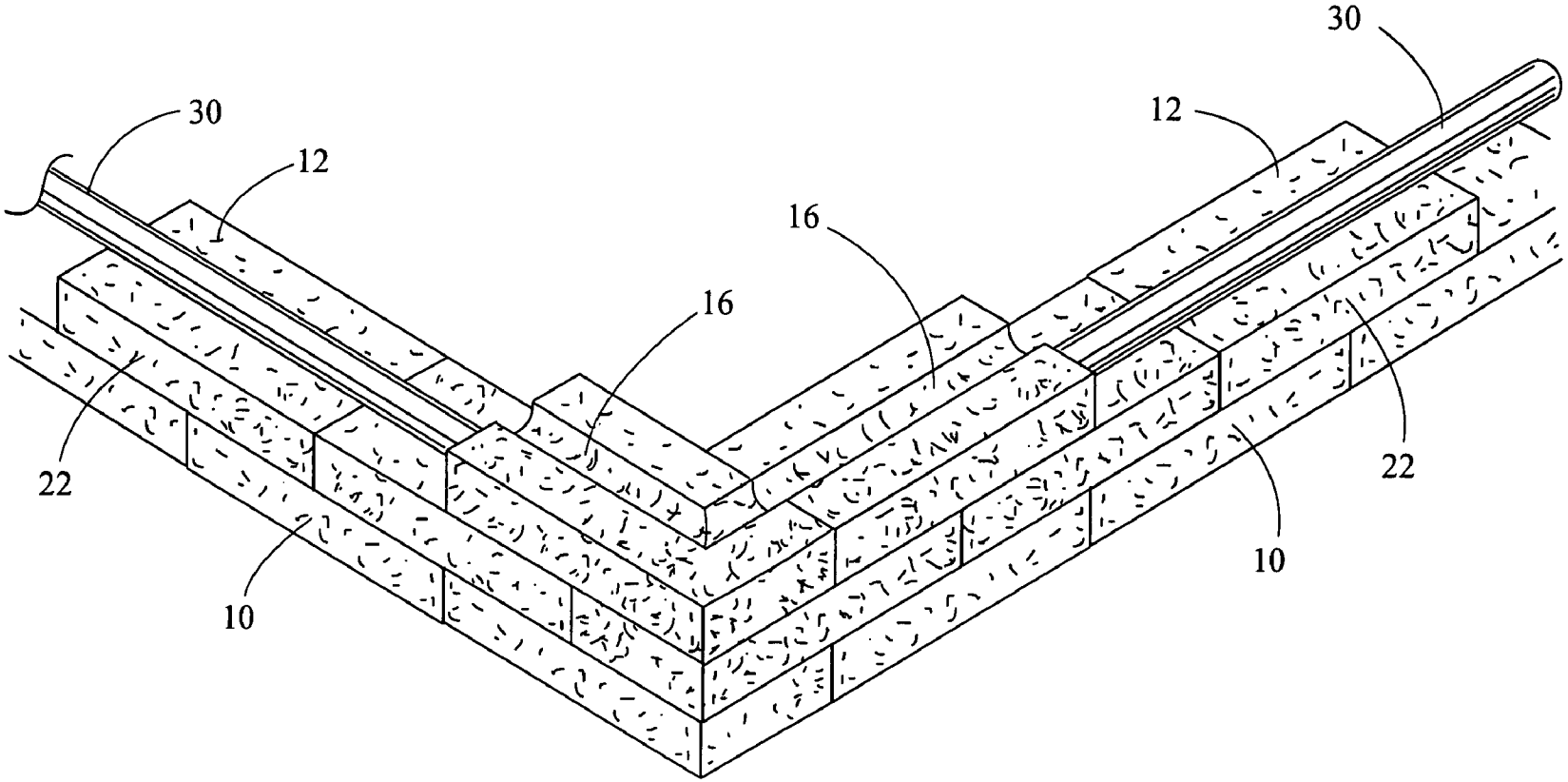
FIG. 3 is a three-dimensional perspective view of a partially assembled lining comprised of insulating firebricks and ceramic inserts of the first embodiment of the present invention.
Figure 4:
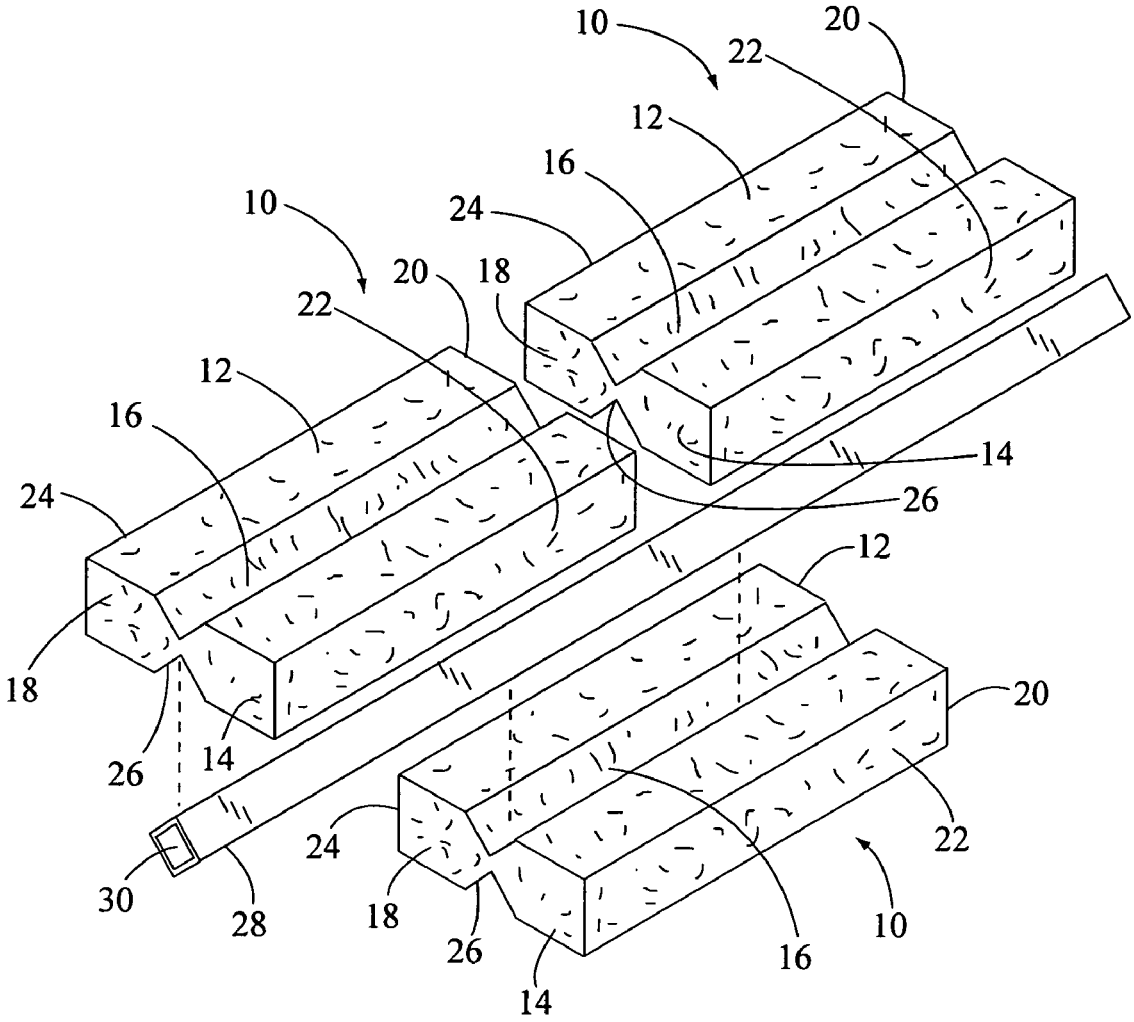
FIG. 4 is a three-dimensional exploded view illustrating an alternate shape groove and insert in an assembly of insulating firebricks and ceramic insert of the first embodiment of the present invention.

FIGS. 2 through 4 illustrate how the interlocking components of the present invention are combined in the construction of an insulating wall or lining. A ceramic insert 28 is placed upon the top face 12 and within upper groove 16 of a first course of one or more insulating firebricks 10. When placed within upper groove 16, ceramic insert 28 extends above top face 12 of the first course of insulating firebricks 10. Further insulating firebricks 10 are then laid in a second course atop the insulating firebricks 10 of the first course with their lower grooves 26 engaging the ceramic insert 28 extending above the top face 12 of the first course of insulating firebrick 10. In constructed form, upper grove 16, in an insulating firebrick 10 of a first course, and lower groove 26, in an insulated firebrick 10 of a second course, form an aperture the internal dimensions of which conform to the external dimensions of ceramic insert 28. Ceramic insert 28 is typically chosen of hollow material having a cavity formed by its inner surface 30; Insulating fiber, an insulating castable, or insulating aggregate may be placed within the cavity formed by the inner surface 30 of ceramic insert 28 to improve its insulating properties. Although insulating firebricks 10 in this first embodiment of the present invention are typically assembled together with refractory mortar joints, refractory fiber may also be used between insulating firebricks 10 to create expansion joints.

In comparing FIGS. 2 and 4, it is illustrated that various shapes of grooves 16 and 26 and ceramic inserts 28 may be utilized in present invention. In FIG. 2, upon assembly, upper grove 16, in an insulating firebrick 10 of a first course, and lower groove 26, in an insulated firebrick 10 of a second course, form an aperture that is circular in cross section and conforms to the external dimensions of ceramic insert 28 which is also circular in cross section. In FIG. 4, upon assembly, upper grove 16, in an insulating firebrick 10 of a first course, and lower groove 26, in an insulated firebrick 10 of a second course, form an aperture that is square in cross section and conforms to the external dimensions of ceramic insert 28 which is also square in cross section.

A second embodiment of the invention, particularly suited for use in sidewall insulation applications in carbon baking furnaces, will now be described with reference to FIGS. 5 through 10.

Figure 5:
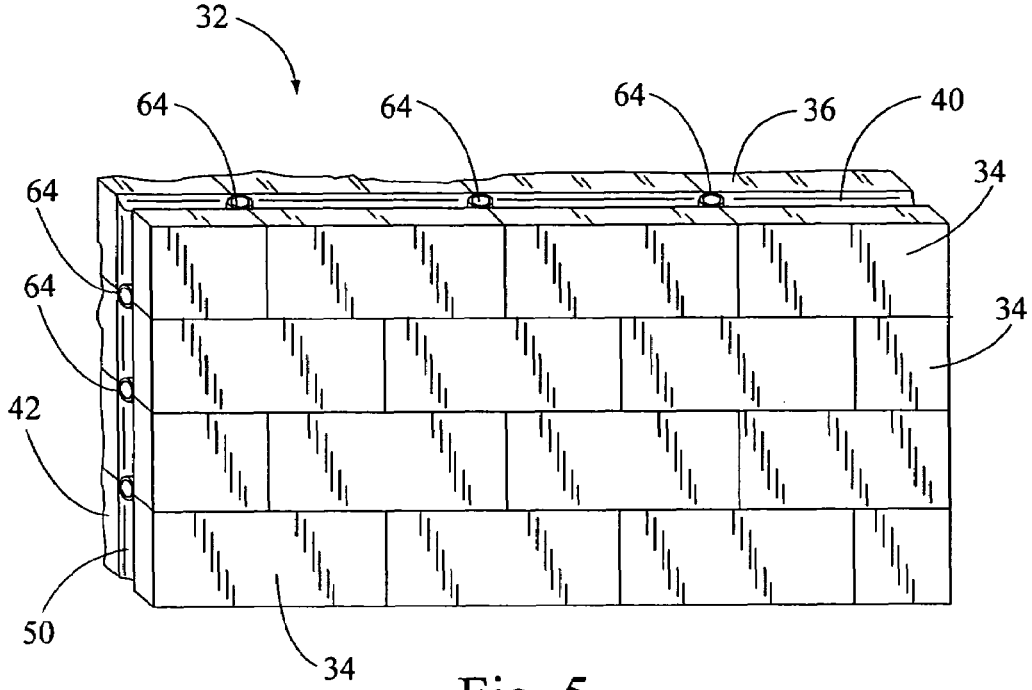
FIG. 5 is a three-dimensional perspective view in a second embodiment of the present invention illustrating a sidewall section assembled from a number of prefabricated insulating modules and ceramic inserts.
Figure 6:
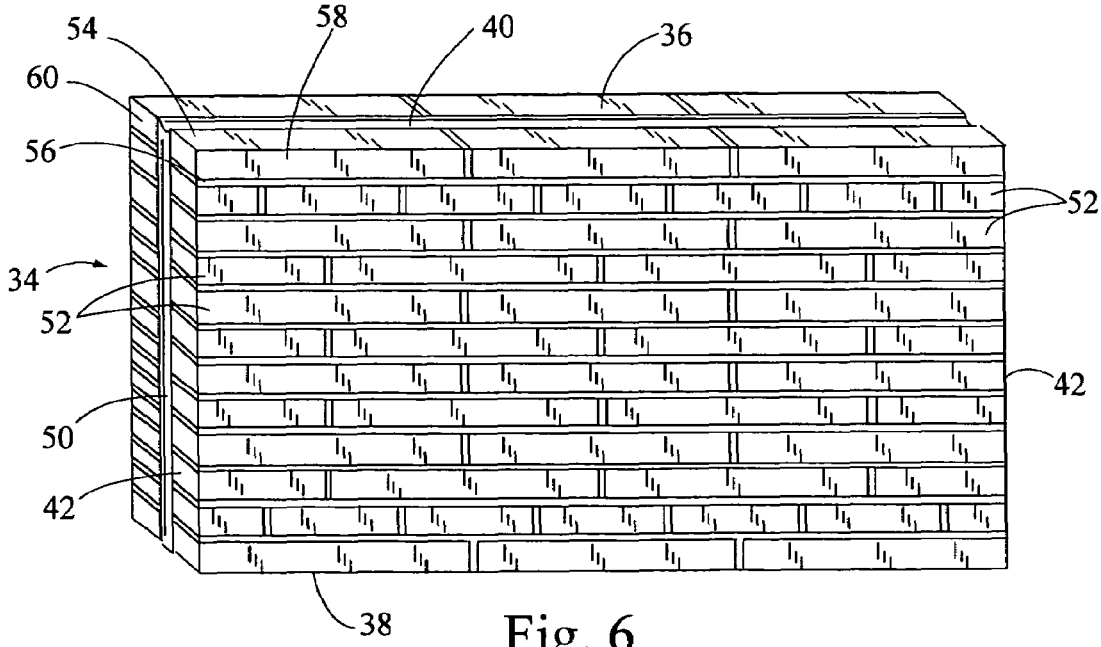
FIG. 6 is a three-dimensional perspective view in a second embodiment of the present invention illustrating a prefabricated insulating module assembled from a number of insulating firebricks.
Figure 7:
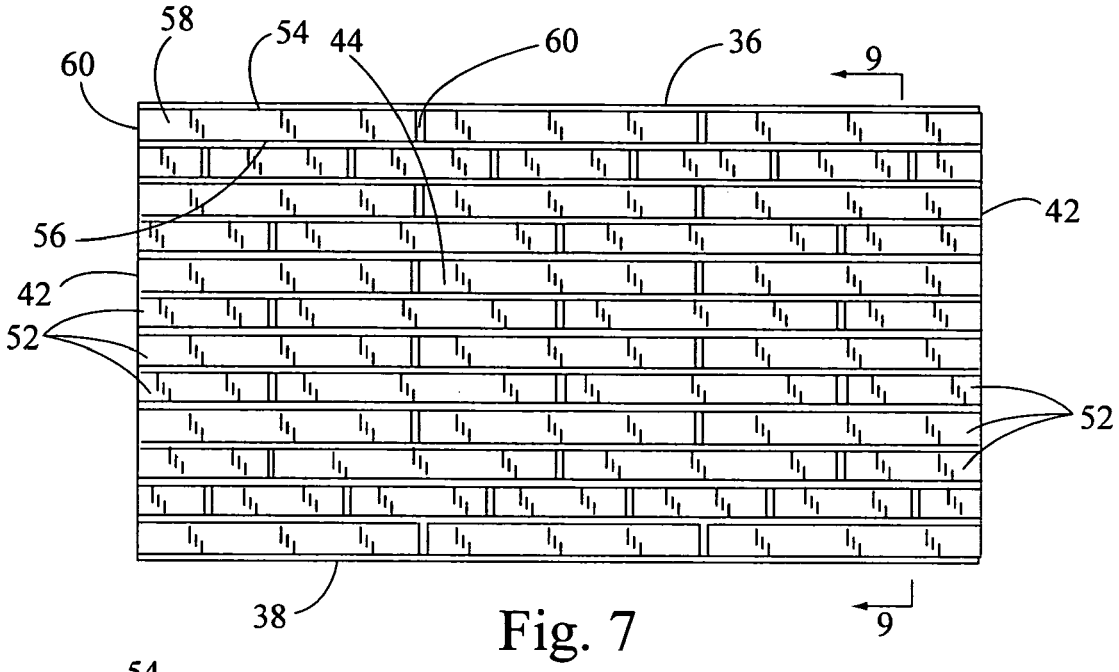
FIG. 7 is a straight on view of the inner face of a prefabricated insulating module in a second embodiment of the present invention.
Figure 8:
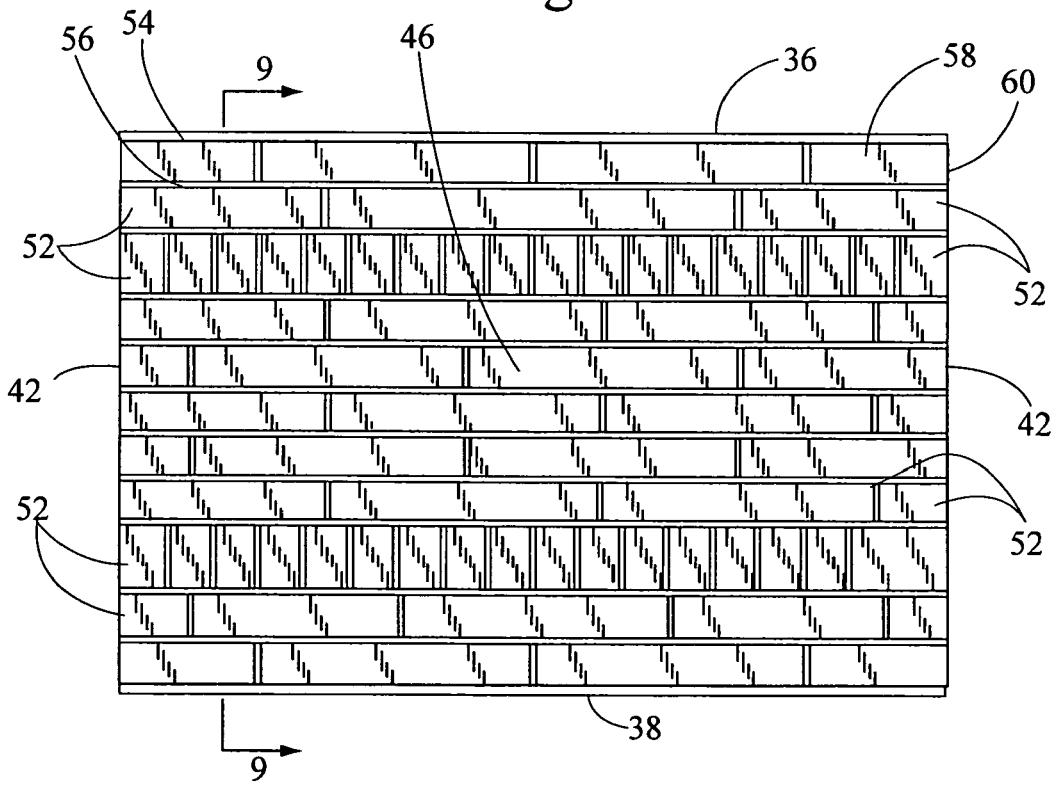
FIG. 8 is a straight on view of the outer face of a prefabricated insulating module in a second embodiment of the present invention.

FIG. 5 illustrates a sidewall section 32 suitable for use as side wall insulation in carbon baking furnaces. Sidewall section 32 is assembled from a number of prefabricated insulating modules 34.

FIGS. 6 through 9 illustrate the composition of the prefabricated insulating modules 34. The uppermost face of a prefabricated insulating module 34 will be referred to as its top face 36; and the lowermost face of a prefabricated insulating module 34 will be referred to as its bottom face 38. An upper groove 40 is fashioned in the top face 36 of prefabricated insulating module 34 extending between its two end faces 42 and perpendicular to inner face 44 and outer face 46. A lower groove 48 is fashioned in the bottom face 38 of insulating module 34 extending between its two end faces 42 and perpendicular to inner face 44 and outer face 46. A side groove 50 is fashioned in each end face 42 extending from top face 36 to bottom face 38 and perpendicular to inner face 44 and outer face 46. Each prefabricated insulating module 34 is assembled from a number of insulating firebricks 52 that are arranged in courses one atop another and a number of rows deep, preferably two, and having joints of refractory mortar between the insulating firebricks 52. The configuration and layout of the insulating firebricks 52 is selected so as minimize the amount of joints aligned among the rows. The uppermost face of each insulating firebrick 52 will be referred to as its top face 54; and the lowermost face of each insulating firebrick 52, will be referred to as its bottom face 56. Further, each insulating firebrick 52 also has 2 side faces 58 and 2 end faces 60. The insulating firebricks 52 used to assemble a prefabricated insulating module 34, are flat sided, except for the insulating firebricks 52 that in an assembled prefabricated insulating module 34 have an exposed top face 54, bottom face 56 or end face 60. Insulating firebricks 52, that in an assembled prefabricated insulating module 34 have an exposed top face 54, bottom face 56 or end face 60, are fashioned with a recess 62 on all exposed faces extending perpendicular to side faces 58. In an assembled prefabricated insulating module 34, the recesses 62 form the upper groove 40, the lower groove 48 and the side grooves 50.

Figure 9:
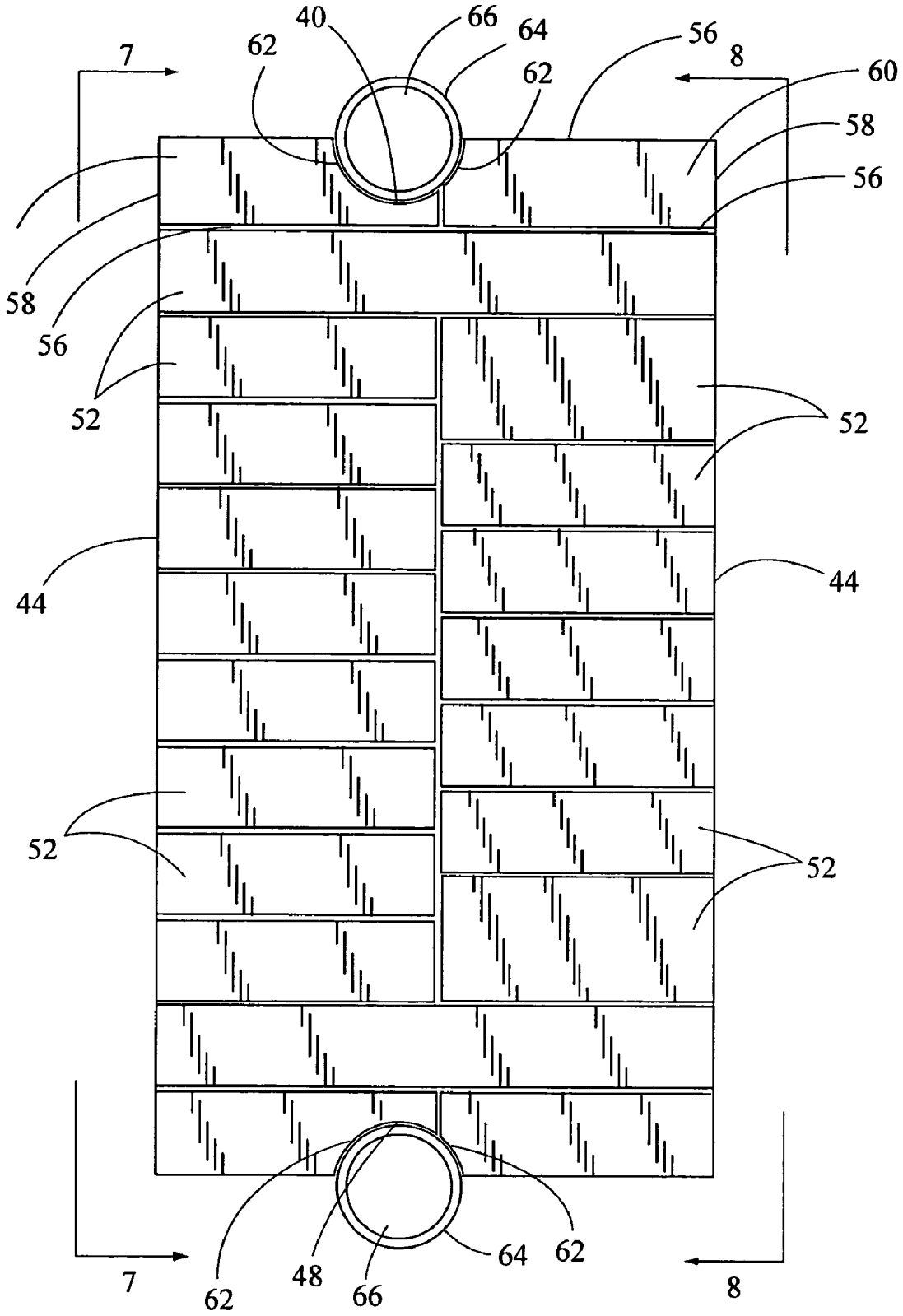
FIG. 9 is a sectional view of a prefabricated insulating module through line 9-9 of FIG. 7 and FIG. 8 in a second embodiment of the present invention illustrating the engagement of a ceramic insert with the upper groove and the engagement of a ceramic insert with the lower groove.
Figure 10:
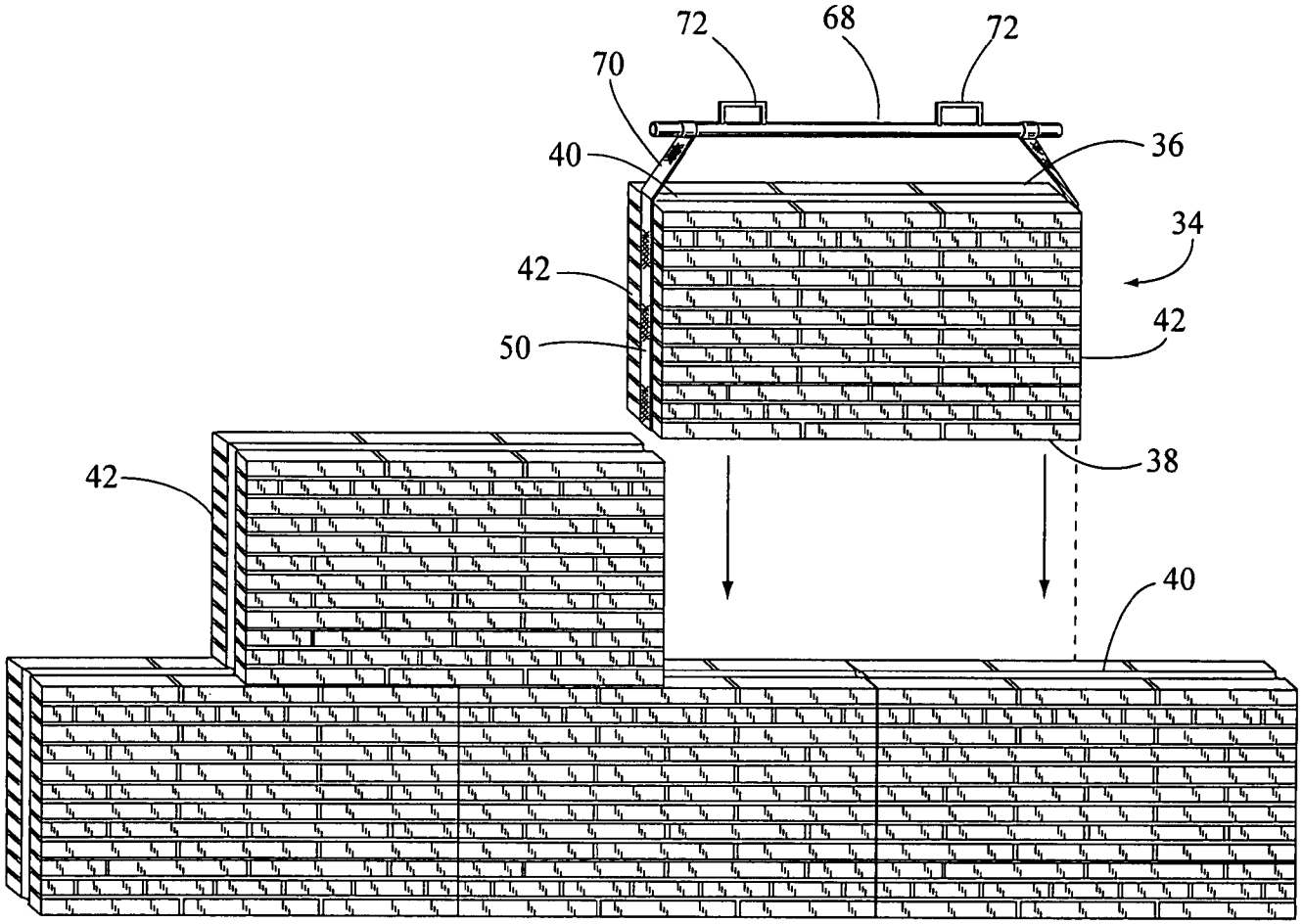
FIG. 10 is a three-dimensional perspective view of a partially assembled sidewall section of a second embodiment of the present invention illustrating the placement of a further pre-fabricated insulating module.

Referring to FIGS. 5, 9 and 10, it will now be described how a sidewall section 32 suitable for use as side wall insulation in carbon baking furnaces is assembled from a number of prefabricated insulating modules 34. Sidewall section 32 is assembled from a number of prefabricated insulating modules 34 which are laid down in courses. As each prefabricated insulating module 34 is laid down next to an adjacent prefabricated insulating module 34 in a course, a ceramic insert 64 is placed between the end faces 42 and within the side grooves 50 of the adjoining prefabricated insulating modules 34. Where a prefabricated insulating modules 34 is laid down in a successive course, A ceramic insert 64 is first placed upon the top face 36 and within upper groove 40 of the lower course of prefabricated insulating modules 34. In constructed form, upper grove 40, in a prefabricated insulating module 34 of a lower course, and lower groove 48, in a prefabricated insulating modules 34 in a successive course, form an aperture the internal dimensions of which conform to the external dimensions of ceramic insert 64. In similar fashion in constructed form, side groove 50, in a prefabricated insulating module 34, and the adjacent side groove 50, in an adjacent prefabricated insulating module 34 in the same course, form an aperture the internal dimensions of which conform to the external dimensions of ceramic insert 64. Ceramic insert 64 is typically chosen of hollow material having a cavity formed by its inner surface 66; Insulating fiber, an insulating castable, or insulating aggregate may be placed within the cavity formed by the inner surface 66 of ceramic insert 64 to improve its insulating properties. The prefabricated insulating modules 34 in this second embodiment of the present invention are typically assembled with refractory fiber used between the prefabricated insulating modules 34 to create expansion joints, but may also be assembled with refractory mortar joints.

As illustrated in FIG. 10, a sidewall section 32 may be readily assembled from prefabricated insulating modules 34. A prefabricated insulating module 34 is suspended from a lifting pipe 68 by a lifting band 70 attached to lifting pipe 68. Lifting band 70 engages the lower groove 48 and the side grooves 50 of the prefabricated insulating module 34 to secure the prefabricated insulating module 34. lifting hooks 72 are provided on lifting pipe 68 that are suitable for attachment to a crane or forklift to allow the prefabricated insulating module 34 to be set in place.

Although the detailed description of the drawings is directed toward illustrating the above described preferred embodiments, the present invention is not limited to such embodiments, as variations and modifications may be made without departing from the scope of the present invention as claimed herein.

What is claimed is:

1. An insulating wall structure comprising a number of insulating fire bricks, said insulating fire bricks having, opposed top and bottom faces, opposed end faces, and opposed side faces, when disposed in an insulating wall structure, with said top face having a top groove machined therein extending between said end faces, and said bottom face having a bottom groove machined therein extending between said end faces;

a number of inserts placed within apertures formed where said top grooves of insulating fire bricks and bottom grooves of other insulating fire bricks are aligned with and face each other, said inserts engaging both said top grooves and said bottom grooves within said apertures, wherein an external surface of said inserts corresponds to an internal surface of said apertures, said inserts have an inner surface defining a cavity, said cavity being filled with a refractory insulating material.

2. An insulating wall structure as recited in claim 1 wherein each of said end faces of said fire brick has an end groove machined therein extending between said top face and said bottom face, said inserts also being placed within apertures formed where end grooves of insulating fire bricks are aligned and face each other, wherein an external surface of said inserts corresponds to an internal surface of said apertures, said inserts have an inner surface defining a cavity, said cavity being filled with a refractory insulating material.

3. An insulating side wall section comprising a number of prefabricated insulating modules, said prefabricated insulating modules being constructed from a number of insulating fire bricks, said prefabricated insulating modules having, opposed top and bottom faces, opposed end faces, and opposed side faces, when disposed in an insulating side wall section, with said top face having a top groove machined therein extending between said end faces, and said bottom face having a bottom groove machined therein extending between said end faces;

a number of inserts placed within apertures formed where said top grooves of said prefabricated insulating modules and said bottom grooves of other prefabricated insulating modules are aligned with and face each other, said inserts engaging both said top grooves and said bottom grooves within said apertures, wherein an external surface of said inserts corresponds to an internal surface of said apertures;

said inserts have an inner surface defining a cavity, said cavity being filled with a refractory insulating material.

4. A prefabricated insulating module suitable for rapid assembly into an insulating side wall section comprising a prefabricated insulating module constructed from a number of insulating fire bricks, said prefabricated insulating modules having, opposed top and bottom faces, opposed end faces, and opposed side faces, when disposed in an insulating side wall section, with said bottom face having a bottom groove extending between said end faces; and a lifting strap engaged within said bottom groove for lifting and aligning said prefabricated insulating module.

5. A prefabricated insulating module as recited in claim 4 wherein each of said end faces has an end groove extending between said, top face and said bottom face, and wherein said lifting strap is engaged within said end grooves.

6. An insulating side wall section as recited in claim 3 wherein each of said end faces has an end groove machined therein extending between said top face and said bottom face, said inserts also being placed within apertures formed where end grooves of prefabricated insulating modules are aligned and face each other, wherein an external surface of said inserts corresponds to an internal surface of said apertures, and said inserts have an inner surface defining a cavity, said cavity being filled with a refractory insulating material.

* * * * *